US009816163B2

(12) United States Patent
Douthett et al.

(10) Patent No.: US 9,816,163 B2
(45) Date of Patent: Nov. 14, 2017

(54) COST-EFFECTIVE FERRITIC STAINLESS STEEL

(71) Applicants: Joseph A. Douthett, Monroe, OH (US); Shannon K. Craycraft, Middletown, OH (US)

(72) Inventors: Joseph A. Douthett, Monroe, OH (US); Shannon K. Craycraft, Middletown, OH (US)

(73) Assignee: AK Steel Properties, Inc.

( * ) Notice: Subject to any disclaimer, the term of this patent is extended or adjusted under 35 U.S.C. 154(b) by 107 days.

(21) Appl. No.: 13/855,439

(22) Filed: Apr. 2, 2013

(65) Prior Publication Data

US 2013/0294960 A1 Nov. 7, 2013

Related U.S. Application Data

(60) Provisional application No. 61/619,048, filed on Apr. 2, 2012.

(51) Int. Cl.

| | |
|---|---|
| ***C22C 38/20*** | (2006.01) |
| ***C22C 38/42*** | (2006.01) |
| ***C22C 38/44*** | (2006.01) |
| ***C22C 38/50*** | (2006.01) |
| ***C22C 38/00*** | (2006.01) |
| ***C22C 38/02*** | (2006.01) |
| ***C22C 38/04*** | (2006.01) |
| ***C22C 38/48*** | (2006.01) |
| ***C21D 6/00*** | (2006.01) |

(52) U.S. Cl.

CPC ..... *C22C 38/001* (2013.01); *C21D 6/002* (2013.01); *C22C 38/02* (2013.01); *C22C 38/04* (2013.01); *C22C 38/20* (2013.01); *C22C 38/42* (2013.01); *C22C 38/44* (2013.01); *C22C 38/48* (2013.01); *C22C 38/50* (2013.01)

(58) Field of Classification Search

CPC ..... C22C 38/18–38/50
USPC ..... 148/325; 420/61
See application file for complete search history.

(56) References Cited

U.S. PATENT DOCUMENTS

| | | | |
|---|---|---|---|
| 2,447,897 | A | 8/1948 | Clarke, Jr. |
| 2,797,993 | A | 7/1957 | Tanczyn |
| 3,833,359 | A | 9/1974 | Murakami et al. |
| 4,154,602 | A | 5/1979 | Kaito et al. |
| 4,690,798 | A | 9/1987 | Narutani et al. |
| 5,217,544 | A | 6/1993 | Baltenneck et al. |
| 5,230,752 | A | 7/1993 | Bourgain et al. |

(Continued)

FOREIGN PATENT DOCUMENTS

| | | | |
|---|---|---|---|
| CA | 2707518 | A1 | 7/2009 |
| CA | 2762899 | A1 | 12/2010 |

(Continued)

OTHER PUBLICATIONS

"JFE443CT, Ni, Mo-free stainless steel with high corrosion resistance: 21Cr Stainless Steel," JFE Steel Corporation, Catalog No. G1E-004-01, 2006.

(Continued)

*Primary Examiner* — Brian Walck
(74) *Attorney, Agent, or Firm* — Frost Brown Todd LLC

(57) ABSTRACT

A cost effective ferritic stainless steel exhibits improved corrosion resistance comparable to that observed on Type 304L steel. The ferritic stainless steel is substantially nickel-free, dual stabilized with titanium and columbium, and contains chromium, copper, and molybdenum.

16 Claims, 10 Drawing Sheets

(56) References Cited

U.S. PATENT DOCUMENTS

| | | | |
|---|---|---|---|
| 5,304,259 | A | 4/1994 | Miyakusu et al. |
| 5,395,583 | A | 3/1995 | Potgieter et al. |
| 5,427,635 | A | 6/1995 | Bletton et al. |
| 5,492,575 | A | 2/1996 | Teraoka et al. |
| 5,565,167 | A | 10/1996 | Fujimoto et al. |
| 5,656,237 | A | 8/1997 | Terrien et al. |
| 5,714,115 | A | 2/1998 | Speidel et al. |
| 5,773,734 | A | 6/1998 | Young |
| 5,779,820 | A | 7/1998 | Hauser et al. |
| 5,785,924 | A | 7/1998 | Beguinot et al. |
| 5,795,411 | A | 8/1998 | Terrien et al. |
| 5,830,408 | A | 11/1998 | Azuma et al. |
| 5,868,875 | A | 2/1999 | Yoshitake et al. |
| 6,033,625 | A | 3/2000 | Nagashima et al. |
| 6,048,416 | A | 4/2000 | Hauser et al. |
| 6,056,917 | A | 5/2000 | Chesseret et al. |
| 6,086,689 | A | 7/2000 | Sassoulas et al. |
| 6,096,441 | A | 8/2000 | Hauser et al. |
| 6,106,639 | A | 8/2000 | Marandel et al. |
| 6,110,300 | A | 8/2000 | Brada et al. |
| 6,123,784 | A | 9/2000 | Havette |
| 6,159,310 | A | 12/2000 | Inoue et al. |
| 6,168,756 | B1 | 1/2001 | Hirasawa et al. |
| 6,171,547 | B1 | 1/2001 | Sagara et al. |
| 6,235,237 | B1 | 5/2001 | Osing et al. |
| 6,294,131 | B1 | 9/2001 | Jaffrey |
| 6,352,670 | B1 | 3/2002 | Rakowski |
| 6,379,476 | B1 | 4/2002 | Tarutani et al. |
| 6,409,847 | B2 | 6/2002 | Kleemann |
| 6,423,159 | B1 | 7/2002 | Liesert et al. |
| 6,426,039 | B2 | 7/2002 | Hirasawa et al. |
| 6,440,236 | B1 | 8/2002 | Hiramatsu et al. |
| 6,440,579 | B1 | 8/2002 | Hauser et al. |
| 6,485,680 | B2 | 11/2002 | Ragot et al. |
| 6,500,280 | B2 | 12/2002 | Ota et al. |
| 6,521,056 | B2 | 2/2003 | Muraki et al. |
| 6,547,891 | B2 | 4/2003 | Linden et al. |
| 6,551,420 | B1 | 4/2003 | Bergstrom et al. |
| 6,564,990 | B2 | 5/2003 | Nagashima et al. |
| 6,582,835 | B2 | 6/2003 | Antoni et al. |
| 6,592,685 | B2 | 7/2003 | Goecmen |
| 6,623,569 | B2 | 9/2003 | Bergstrom et al. |
| 6,645,324 | B2 | 11/2003 | Hirata et al. |
| 6,673,165 | B2 | 1/2004 | Koga et al. |
| 6,673,166 | B2 | 1/2004 | Oku et al. |
| 6,682,582 | B1 | 1/2004 | Speidel |
| 6,682,780 | B2 | 1/2004 | Tzatzov et al. |
| 6,692,592 | B2 | 2/2004 | Kidani et al. |
| 6,696,016 | B1 | 2/2004 | Kimura |
| 6,723,181 | B2 | 4/2004 | Ishikawa et al. |
| 6,740,174 | B2 | 5/2004 | Miyazaki et al. |
| 6,793,744 | B1 | 9/2004 | Jung |
| 6,793,746 | B2 | 9/2004 | Shimizu et al. |
| 6,855,213 | B2 | 2/2005 | Yoshitake et al. |
| 6,921,440 | B2 | 7/2005 | Liesert et al. |
| 7,081,173 | B2 | 7/2006 | Bahar et al. |
| 7,094,295 | B2 | 8/2006 | Oku et al. |
| 7,166,174 | B2 | 1/2007 | De Bondt et al. |
| 7,255,755 | B2 | 8/2007 | Maziasz et al. |
| 7,335,428 | B2 | 2/2008 | Fraisse et al. |
| 7,341,690 | B2 | 3/2008 | Miyazaki et al. |
| 7,343,730 | B2 | 3/2008 | Humcke et al. |
| 7,476,282 | B2 | 1/2009 | Tanida et al. |
| 7,531,129 | B2 | 5/2009 | Igarashi et al. |
| 7,572,407 | B2 | 8/2009 | Hirasawa et al. |
| 7,731,895 | B2 | 6/2010 | Okada et al. |
| 7,749,431 | B2 | 7/2010 | Igarashi et al. |
| RE41,504 | E | 8/2010 | Maziasz et al. |
| 7,767,037 | B2 | 8/2010 | Kimura et al. |
| 7,780,798 | B2 | 8/2010 | Stinson et al. |
| 7,819,991 | B2 | 10/2010 | Kato et al. |
| 7,842,141 | B2 | 11/2010 | Kimura et al. |
| 7,923,126 | B2 | 4/2011 | Gudme |
| 7,981,561 | B2 | 7/2011 | Rakowski et al. |
| 8,025,839 | B2 | 9/2011 | Jonson et al. |
| 8,062,584 | B2 | 11/2011 | Hamada et al. |
| 8,152,937 | B2 | 4/2012 | Ishii et al. |
| 8,153,055 | B2 | 4/2012 | Nakamura et al. |
| 8,226,780 | B2 | 7/2012 | Hatano et al. |
| 8,268,101 | B2 | 9/2012 | Conrad et al. |
| 8,287,805 | B2 | 10/2012 | Sjodin |
| 8,303,733 | B2 | 11/2012 | Hamada et al. |
| 8,333,849 | B2 | 12/2012 | Yamauchi et al. |
| 8,333,851 | B2 | 12/2012 | Suwabe |
| 8,337,748 | B2 | 12/2012 | Rakowski et al. |
| 8,337,749 | B2 | 12/2012 | Bergstrom et al. |
| 8,357,247 | B2 | 1/2013 | Hirasawa et al. |
| 8,506,727 | B2 | 8/2013 | Pelsoeczy |
| 8,535,606 | B2 | 9/2013 | John |
| 8,540,933 | B2 | 9/2013 | Nylof et al. |
| 8,562,758 | B2 | 10/2013 | Fujisawa et al. |
| 8,580,048 | B2 | 11/2013 | Pelsoeczy |
| 8,608,873 | B2 | 12/2013 | Abratis et al. |
| 8,663,549 | B2 | 3/2014 | Ohishi et al. |
| 8,721,960 | B2 | 5/2014 | Hatano et al. |
| 8,790,573 | B2 | 7/2014 | Miyazaki et al. |
| 8,877,121 | B2 | 11/2014 | Bergstrom et al. |
| 8,894,924 | B2 | 11/2014 | Matsuhashi et al. |
| 8,980,167 | B2 | 3/2015 | Kimura et al. |
| 9,150,947 | B2 | 10/2015 | Nishiyama et al. |
| 9,181,824 | B2 | 11/2015 | Montagnon |
| 9,279,172 | B2 | 3/2016 | Kato et al. |
| 9,290,845 | B2 | 3/2016 | Kim et al. |
| 2002/0033210 | A1 | 3/2002 | Fujitsuna et al. |
| 2003/0086810 | A1 | 5/2003 | Schnabel et al. |
| 2003/0172999 | A1 | 9/2003 | Alfonsson et al. |
| 2004/0040631 | A1 | 3/2004 | Takahashi et al. |
| 2004/0050462 | A1 | 3/2004 | Grubb |
| 2004/0074574 | A1 | 4/2004 | Kimura |
| 2004/0156737 | A1 | 8/2004 | Rakowski |
| 2004/0166015 | A1 | 8/2004 | Kimura |
| 2004/0244884 | A1 | 12/2004 | Hideshima et al. |
| 2005/0139298 | A1 | 6/2005 | Pacher et al. |
| 2005/0217769 | A1 | 10/2005 | Pacher et al. |
| 2005/0269074 | A1 | 12/2005 | Chitwood |
| 2006/0008694 | A1 | 1/2006 | Budinski et al. |
| 2006/0150388 | A1 | 7/2006 | Inada et al. |
| 2006/0266439 | A1 | 11/2006 | Maziasz et al. |
| 2006/0285989 | A1 | 12/2006 | Schade |
| 2007/0089810 | A1 | 4/2007 | Sundstrom et al. |
| 2007/0187002 | A1 | 8/2007 | Takahashi et al. |
| 2008/0073004 | A1 | 3/2008 | Pacher et al. |
| 2008/0206088 | A1 | 8/2008 | Cusolito et al. |
| 2009/0032246 | A1 | 2/2009 | Takabe et al. |
| 2009/0053093 | A1 | 2/2009 | Oku et al. |
| 2009/0060775 | A1 | 3/2009 | Liu |
| 2009/0111607 | A1 | 4/2009 | Taylor et al. |
| 2009/0324441 | A1 | 12/2009 | Weiss et al. |
| 2010/0000636 | A1 | 1/2010 | Bonnefois et al. |
| 2010/0133096 | A1 | 6/2010 | Hansen et al. |
| 2010/0183475 | A1 | 7/2010 | Radon et al. |
| 2010/0189589 | A1 | 7/2010 | Liu |
| 2010/0223927 | A1 | 9/2010 | Oku et al. |
| 2010/0272593 | A1 | 10/2010 | Ishikawa et al. |
| 2011/0061777 | A1 | 3/2011 | Ishii et al. |

FOREIGN PATENT DOCUMENTS

| | | | |
|---|---|---|---|
| CA | 2860746 | A1 | 8/2013 |
| CN | 86101805 | A | 8/1986 |
| CN | 101680066 | A | 3/2010 |
| CN | 101784686 | A | 7/2010 |
| EP | 0547626 | | 6/1993 |
| EP | 0638653 | | 2/1995 |
| JP | S56-146857 | A | 11/1981 |
| JP | S58-39732 | A | 3/1983 |
| JP | S60-2622 | A | 1/1985 |
| JP | H04-280948 | A | 10/1992 |
| JP | H08-199314 | A | 8/1996 |
| JP | H08 246105 | | 9/1996 |
| JP | H08 311543 | | 11/1996 |
| JP | H09 227999 | | 9/1997 |
| JP | H09 228002 | | 9/1997 |
| JP | H10 81940 | | 3/1998 |

(56) References Cited

FOREIGN PATENT DOCUMENTS

| | | | |
|---|---|---|---|
| JP | 2006-097908 | A | 4/2006 |
| JP | 2006-131945 | | 5/2006 |
| JP | 2006-257544 | A | 9/2006 |
| JP | 2007-131870 | A | 5/2007 |
| JP | 2007-302995 | A | 11/2007 |
| JP | 2008-291303 | A | 12/2008 |
| JP | 2009-035813 | A | 2/2009 |
| JP | 2010-202916 | A | 9/2010 |
| JP | 2010-202973 | A | 9/2010 |
| JP | 2011-179116 | | 9/2011 |
| RU | 2132886 | C1 | 7/1999 |
| RU | 2242325 | C2 | 12/2004 |
| RU | 2429306 | C1 | 9/2011 |
| TW | I482866 | B | 5/2015 |
| UA | 111115 | C2 | 3/2016 |
| WO | WO 2008/156195 | A1 | 12/2008 |

OTHER PUBLICATIONS

International Search Report and Written Opinion dated Jul. 24, 2013 for Application No. PCT/US2013/034940.
English Abstract of Japanese Patent No. JP H08 246105.
English Abstract of Japanese Patent No. JP H08 311543.
English Abstract of Japanese Patent No. JP H09 227999.
English Abstract of Japanese Patent No. JP H09 228002.
English Abstract of Japanese Patent No. JP H10 91940.
"JFE443CT, Ni, Mo-free stainless steel with high corrosion resistance: 21Cr Stainless Steel," JFE Steel Corporation, Catalog No. G1E-004-03, 2012, accessed from: http://www.jfe-steel.co.jp/en/products/stainless/catalog/gle-004.pdf.
Canadian Office Action dated Jan. 22, 2016 for Application No. CA 2,868,278, 6 pgs.
Chinese Office Action dated Sep. 18, 2015 for Application No. CN 201380018563.7, 8 pgs.
European Exam Report dated Sep. 1, 2015 for Application No. EP 13716682.3, 5 pgs.
Japanese Office Action dated Nov. 10, 2015 for Application No. JP 2015-504675, 9 pgs.
Korean Office Action dated Oct. 12, 2015 for Application No. KR 10-2014-7030826, 5 pgs.
Russian Office Action dated Apr. 8, 2016 for Application No. RU 2014138182/02(061887), 14 pgs.
Taiwanese Search Report dated Jun. 23, 2014 for Application No. TW 102111957, 6 pgs.
Ukrainian Office Action dated Dec. 12, 2014 for Application No. UA a 2014 10374, 4 pgs.
Korean Office Action, Notice of Final Rejection, dated Feb. 16, 2017 for Application No. 10-2014-7030826, 6 pages.
Australian Office Action dated Oct. 6, 2016 for Application No. 2013243635, 3 pages.
Canadian Office Action dated Nov. 23, 2016 for Application No. 2,868,278, 3 pages.
Chinese Office Action dated May 10, 2016 for Application No. 201380018563.7, 8 pages.
Chinese Office Action dated Dec. 8, 2016 for Application No. 201380018563.7, 11 pages.
Japanese Office Action, Examiner's Decision of Refusal, dated Aug. 16, 2016 for Application No. 2015-504675, 8 pages.
Korean Office Action, Notice of Final Rejection, dated Jun. 20, 2016 for Application No. 10-2014-7030826, 6 pages.
Korean Office Action, Notice of Preliminary Rejection, dated Sep. 27, 2016 for Application No. 10-2014-7030826, 7 pages.
Russian Office Action, Notice of Allowance, dated Jul. 8, 2016 for Application No. 2014138182/02, 13 pages.

COST-EFFECTIVE FERRITIC STAINLESS STEEL

This application is a non-provisional patent application claiming priority from provisional application Ser. No. 61/619,048 entitled "21% Cr Ferritic Stainless Steel," filed on Apr. 2, 2012. The disclosure of application Ser. No. 61/619,048 is incorporated herein by reference.

SUMMARY

It is desirable to produce a ferritic stainless steel with corrosion resistance comparable to that of ASTM Type 304 stainless steel but that is substantially nickel-free, dual stabilized with titanium and columbium to provide protection from intergranular corrosion, and contains chromium, copper, and molybdenum to provide pitting resistance without sacrificing stress corrosion cracking resistance. Such a steel is particularly useful for commodity steel sheet commonly found in commercial kitchen applications, architectural components, and automotive applications, including but not limited to commercial and passenger vehicle exhaust and selective catalytic reduction (SCR) components.

DETAILED DESCRIPTION

In the ferritic stainless steels, the inter-relationship of and amount of titanium, columbium, carbon, and nitrogen are controlled to achieve subequilibrium surface quality, substantially equiaxed cast grain structure, and substantially full stabilization against intergranular corrosion. In addition, the inter-relationship of chromium, copper, and molybdenum is controlled to optimize corrosion resistance.

Figure 1:
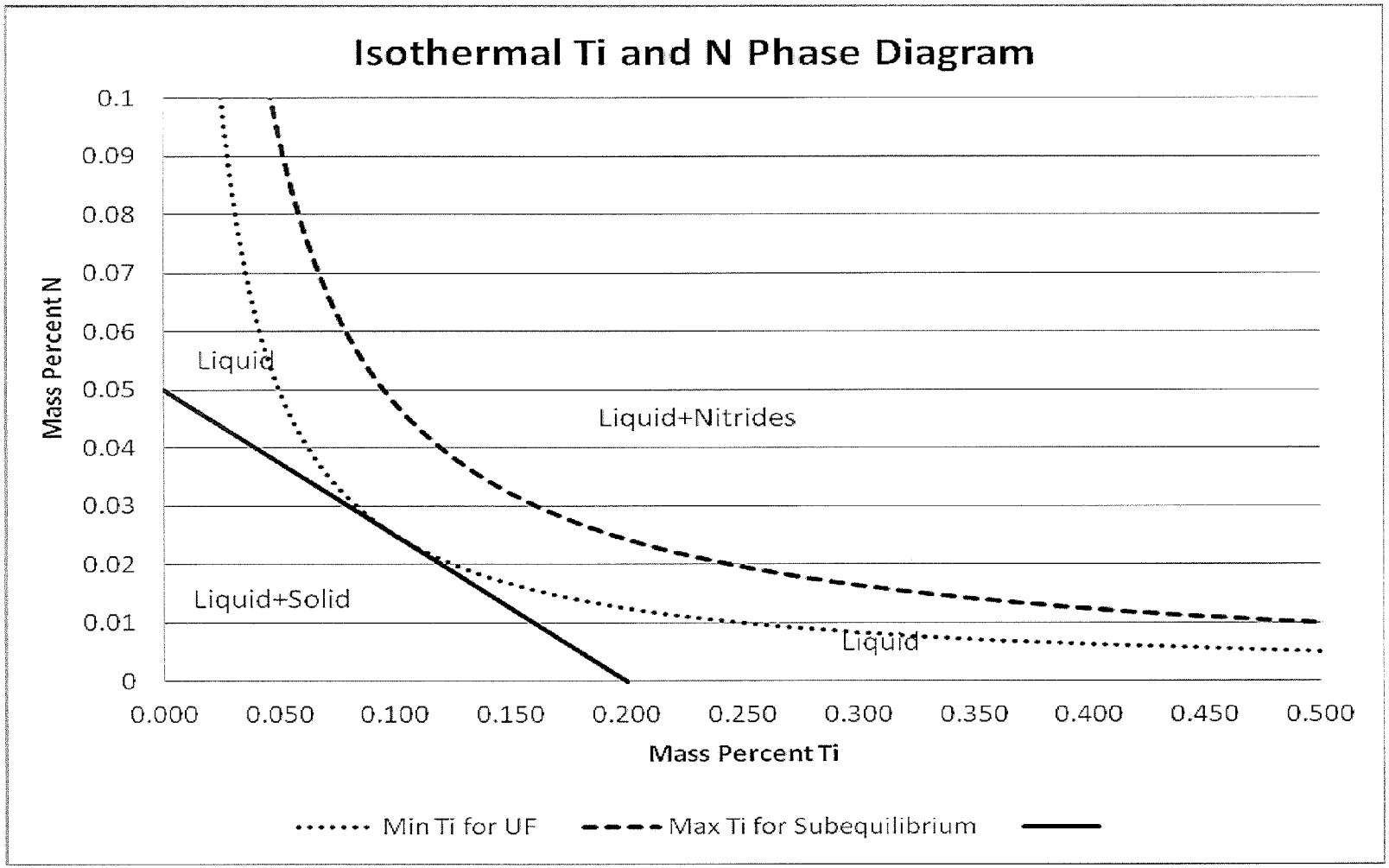
FIG. 1 is a phase diagram for elements of titanium and nitrogen at the liquidus temperature for an embodiment of the ferritic stainless steel.

Subequilibrium melts are typically defined as compositions with titanium and nitrogen levels low enough so that they do not form titanium nitrides in the alloy melt. Such precipitates can form defects, such as surface stringer defects or laminations, during hot or cold rolling. Such defects can diminish formability, corrosion resistance, and appearance. FIG. 1 was derived from an exemplary phase diagram, created using thermodynamic modeling for elements of titanium and nitrogen at the liquidus temperature for an embodiment of the ferritic stainless steel. To be substantially free of titanium nitrides and be considered subequilibrium, the titanium and nitrogen levels in the ferritic stainless steel should fall to the left or lower portion of the solubility curve shown in FIG. 1. The titanium nitride solubility curve, as shown in FIG. 1, can be represented mathematically as follows:

$$Ti_{max}=0.0044(N^{-1.027}) \quad \text{Equation 1:}$$

where $Ti_{max}$ is the maximum concentration of titanium by percent weight, and N is the concentration of nitrogen by percent weight. All concentrations herein will be reported by percent weight, unless expressly noted otherwise.

Using Equation 1, if the nitrogen level is maintained at or below 0.020% in an embodiment, then the titanium concentration for that embodiment should be maintained at or below 0.25%. Allowing the titanium concentration to exceed 0.25% can lead to the formation of titanium nitride precipitates in the molten alloy. However, FIG. 1 also shows that titanium levels above 0.25% can be tolerated if the nitrogen levels are less than 0.02%.

Embodiments of the ferritic stainless steels exhibit an equiaxed cast and rolled and annealed grain structure with no large columnar grains in the slabs or banded grains in the rolled sheet. This refined grain structure can improve formability and toughness. To achieve this grain structure, there should be sufficient titanium, nitrogen and oxygen levels to seed the solidifying slabs and provide sites for equiaxed grains to initiate. In such embodiments, the minimum titanium and nitrogen levels are shown in FIG. 1, and expressed by the following equation:

$$Ti_{min}=0.0025/N \quad \text{Equation 2:}$$

where $Ti_{min}$ is the minimum concentration of titanium by percent weight, and N is the concentration of nitrogen by percent weight.

Using the Equation 2, if the nitrogen level is maintained at or below 0.02% in an embodiment, the minimum titanium concentration is 0.125%. The parabolic curve depicted in FIG. 1 reveals an equiaxed grain structure can be achieved at nitrogen levels above 0.02% nitrogen if the total titanium concentration is reduced. An equiaxed grain structure is expected with titanium and nitrogen levels to the right or above of plotted Equation 2. This relationship between subequilibrium and titanium and nitrogen levels that produced equiaxed grain structure is illustrated in FIG. 1, in which the minimum titanium equation (Equation 2) is plotted on the liquidus phase diagram of FIG. 1. The area between the two parabolic lines is the range of titanium and nitrogen levels in the embodiments.

Fully stabilized melts of the ferritic stainless steels must have sufficient titanium and columbium to combine with the soluble carbon and nitrogen present in the steel. This helps to prevent chromium carbide and nitrides from forming and lowering the intergranular corrosion resistance. The minimum titanium and carbon necessary to lead to full stabilization is best represented by the following equation:

$$Ti+Cb_{min}=0.2\%+4(C+N) \quad \text{Equation 3:}$$

where Ti is the amount of titanium by percent weight, $Cb_{min}$ is the minimum amount of columbium by percent weight, C is the amount of carbon by percent weight, and N is the amount of nitrogen by percent weight.

In the embodiments described above, the titanium level necessary for an equiaxed grain structure and subequilibrium conditions was determined when the maximum nitrogen level was 0.02%. As explained above, the respective Equations 1 and 2 yielded 0.125% minimum titanium and 0.25% maximum titanium. In such embodiments, using a maximum of 0.025% carbon and applying Equation 3, would require minimum columbium contents of 0.25% and 0.13%, respectively for the minimum and maximum titanium levels. In some such embodiments, the aim for the concentration of columbium would be 0.25%.

In certain embodiments, keeping the copper level between 0.40-0.80% in a matrix consisting of about 21% Cr and 0.25% Mo one can achieve an overall corrosion resistance that is comparable if not improved to that found in commercially available Type 304L. The one exception may be in the presence of a strongly acidic reducing chloride like hydrochloric acid. The copper-added alloys show improved performance in sulfuric acid. When the copper level is maintained between 0.4-0.8%, the anodic dissolution rate is reduced and the electrochemical breakdown potential is maximized in neutral chloride environments. In some embodiments, the optimal Cr, Mo, and Cu level, in weight percent satisfies the following two equations:

$$20.5 \leq Cr+3.3Mo \quad \text{Equation 4:}$$

$$0.6 \leq Cu+Mo \leq 1.4 \text{ when } Cu_{max} < 0.80 \quad \text{Equation 5:}$$

Embodiments of the ferritic stainless steel can contain carbon in amounts of about 0.020 or less percent by weight.

Embodiments of the ferritic stainless steel can contain manganese in amounts of about 0.40 or less percent by weight.

Embodiments of the ferritic stainless steel can contain phosphorus in amounts of about 0.030 or less percent by weight.

Embodiments of the ferritic stainless steel can contain sulfur in amounts of about 0.010 or less percent by weight.

Embodiments of the ferritic stainless steel can contain silicon in amounts of about 0.30-0.50 percent by weight. Some embodiments can contain about 0.40% silicon.

Embodiments of the ferritic stainless steel can contain chromium in amounts of about 20.0-23.0 percent by weight. Some embodiments can contain about 21.5-22 percent by weight chromium, and some embodiments can contain about 21.75% chromium.

Embodiments of the ferritic stainless steel can contain nickel in amounts of about 0.40 or less percent by weight.

Embodiments of the ferritic stainless steel can contain nitrogen in amounts of about 0.020 or less percent by weight.

Embodiments of the ferritic stainless steel can contain copper in amounts of about 0.40-0.80 percent by weight. Some embodiments can contain about 0.45-0.75 percent by weight copper and some embodiments can contain about 0.60% copper.

Embodiments of the ferritic stainless steel can contain molybdenum in amounts of about 0.20-0.60 percent by weight. Some embodiments can contain about 0.30-0.5 percent by weight molybdenum, and some embodiments can contain about 0.40% molybdenum.

Embodiments of the ferritic stainless steel can contain titanium in amounts of about 0.10-0.25 percent by weight. Some embodiments can contain about 0.17-0.25 percent by weight titanium, and some embodiments can contain about 0.21% titanium.

Embodiments of the ferritic stainless steel can contain columbium in amounts of about 0.20-0.30 percent by weight. Some embodiments can contain about 0.25% columbium.

Embodiments of the ferritic stainless steel can contain aluminum in amounts of about 0.010 or less percent by weight.

The ferritic stainless steels are produced using process conditions known in the art for use in manufacturing ferritic stainless steels, such as the processes described in U.S. Pat. Nos. 6,855,213 and 5,868,875.

In some embodiments, the ferritic stainless steels may also include other elements known in the art of steelmaking that can be made either as deliberate additions or present as residual elements, i.e., impurities from steelmaking process.

A ferrous melt for the ferritic stainless steel is provided in a melting furnace such as an electric arc furnace. This ferrous melt may be formed in the melting furnace from solid iron bearing scrap, carbon steel scrap, stainless steel scrap, solid iron containing materials including iron oxides, iron carbide, direct reduced iron, hot briquetted iron, or the melt may be produced upstream of the melting furnace in a blast furnace or any other iron smelting unit capable of providing a ferrous melt. The ferrous melt then will be refined in the melting furnace or transferred to a refining vessel such as an argon-oxygen-decarburization vessel or a vacuum-oxygen-decarburization vessel, followed by a trim station such as a ladle metallurgy furnace or a wire feed station.

In some embodiments, the steel is cast from a melt containing sufficient titanium and nitrogen but a controlled amount of aluminum for forming small titanium oxide inclusions to provide the necessary nuclei for forming the as-cast equiaxed grain structure so that an annealed sheet produced from this steel also has enhanced ridging characteristics.

In some embodiments, titanium is added to the melt for deoxidation prior to casting. Deoxidation of the melt with titanium forms small titanium oxide inclusions that provide the nuclei that result in an as-cast equiaxed fine grain structure. To minimize formation of alumina inclusions, i.e., aluminum oxide, $Al_2O_3$, aluminum may not be added to this refined melt as a deoxidant. In some embodiments, titanium and nitrogen can be present in the melt prior to casting so that the ratio of the product of titanium and nitrogen divided by residual aluminum is at least about 0.14.

If the steel is to be stabilized, sufficient amount of the titanium beyond that required for deoxidation can be added for combining with carbon and nitrogen in the melt but preferably less than that required for saturation with nitrogen, i.e., in a sub-equilibrium amount, thereby avoiding or at least minimizing precipitation of large titanium nitride inclusions before solidification.

The cast steel is hot processed into a sheet. For this disclosure, the term "sheet" is meant to include continuous strip or cut lengths formed from continuous strip and the term "hot processed" means the as-cast steel will be reheated, if necessary, and then reduced to a predetermined thickness such as by hot rolling. If hot rolled, a steel slab is reheated to 2000° to 2350° F. (1093°-1288° C.), hot rolled using a finishing temperature of 1500-1800° F. (816-982° C.) and coiled at a temperature of 1000-1400° F. (538-760° C.). The hot rolled sheet is also known as the "hot band." In some embodiments, the hot band may be annealed at a peak metal temperature of 1700-2100° F. (926-1149° C.). In some embodiments, the hot band may be descaled and cold reduced at least 40% to a desired final sheet thickness. In other embodiments, the hot band may be descaled and cold reduced at least 50% to a desired final sheet thickness. Thereafter, the cold reduced sheet can be final annealed at a peak metal temperature of 1700-2100° F. (927-1149° C.).

The ferritic stainless steel can be produced from a hot processed sheet made by a number of methods. The sheet can be produced from slabs formed from ingots or continuous cast slabs of 50-200 mm thickness which are reheated to 2000° to 2350° F. (1093°-1288° C.) followed by hot rolling to provide a starting hot processed sheet of 1-7 mm thickness or the sheet can be hot processed from strip continuously cast into thicknesses of 2-26 mm. The present process is applicable to sheet produced by methods wherein continuous cast slabs or slabs produced from ingots are fed directly to a hot rolling mill with or without significant reheating, or ingots hot reduced into slabs of sufficient temperature to be hot rolled in to sheet with or without further reheating.

EXAMPLE 1

To prepare ferritic stainless steel compositions that resulted in an overall corrosion resistance comparable to Type 304L austenitic stainless steel a series of laboratory heats were melted and analyzed for resistance to localized corrosion.

The first set of heats was laboratory melted using air melt capabilities. The goal of this series of air melts was to better understand the role of chromium, molybdenum, and copper in a ferritic matrix and how the variations in composition compare to the corrosion behavior of Type 304L steel. For this study the compositions of embodiments used in the air melts investigated are set forth in Table 1 as follows:

TABLE 1

| Code | Stencil | C | Mn | P | S | Si | Cr | Ni | Cu | Mo | N | Cb | Ti |
|---|---|---|---|---|---|---|---|---|---|---|---|---|---|
| A | 251 | 0.016 | 0.36 | 0.033 | 0.0016 | 0.4 | 20.36 | 0.25 | 0.5 | 0.002 | 0.024 | 0.2 | 0.15 |
| B | 302 | 0.013 | 0.33 | 0.033 | 0.0015 | 0.39 | 20.36 | 0.25 | 0.48 | 0.25 | 0.024 | 0.2 | 0.11 |
| C | 262 | 0.014 | 0.31 | 0.032 | 0.0015 | 0.37 | 20.28 | 0.25 | 0.48 | 0.49 | 0.032 | 0.19 | 0.13 |
| D | 301 | 0.012 | 0.34 | 0.032 | 0.0017 | 0.39 | 20.37 | 0.25 | 0.09 | 0.25 | 0.024 | 0.2 | 0.15 |
| E | 272 | 0.014 | 0.3 | 0.031 | 0.0016 | 0.36 | 20.22 | 0.24 | 1.01 | 0.28 | 0.026 | 0.19 | 0.12 |
| F | 271 | 0.014 | 0.31 | 0.032 | 0.0015 | 0.36 | 18.85 | 0.25 | 0.49 | 0.28 | 0.024 | 0.2 | 0.15 |
| G | 28 | 0.012 | 0.36 | 0.033 | 0.0016 | 0.41 | 21.66 | 0.25 | 0.49 | 0.25 | 0.026 | 0.2 | 0.12 |
| H | 29 | 0.014 | 0.35 | 0.033 | 0.0014 | 0.41 | 20.24 | 0.25 | 1 | 0.5 | 0.026 | 0.18 | 0.15 |

Both ferric chloride immersion and electrochemical evaluations were performed on all the above mentioned chemistries in Table 1 and compared to the performance of Type 304L steel.

Following methods described in ASTM 648 Ferric Chloride Pitting Test Method A, specimens were evaluated for mass loss after a 24 hour exposure to 6% Ferric Chloride solution at 50° C. This test exposure evaluates the basic resistance to pitting corrosion while exposed to an acidic, strongly oxidizing, chloride environment.

The screening test suggested that higher chromium bearing ferritic alloys that have a small copper addition would result in the most corrosion resistance composition within the series. The composition having the highest copper content of 1% did not perform as well as the other chemistries. However, this behavior may have been as a result of less than ideal surface quality due to the melting process.

A closer investigation of the passive film strength and repassivation behavior was studied using electrochemical techniques that included both corrosion behavior diagrams (CBD) and cycle polarization in a deaerated, dilute, neutral chloride environment. The electrochemical behavior observed on this set of air melts showed that a combination of approximately 21% Cr while in the presence of approximately 0.5% Cu and a small Mo addition achieved three primary improvements to Type 304L steel. First, the copper addition appeared to slow the initial anodic dissolution rate at the surface; second, the copper and small molybdenum presence in the 21% Cr chemistry assisted in a strong passive film formation; and third, the molybdenum and high chromium content assisted in the improved repassivation behavior. The level of copper in the 21Cr+ residual Mo melt chemistry did appear to have an "optimal" level in that adding 1% Cu resulted in diminished return. This confirms the behavior observed in the ferric chloride pitting test. Additional melt chemistries were submitted for vacuum melting in hopes to create cleaner steel specimens and determine the optimal copper addition in order to achieve the best overall corrosion resistance.

EXAMPLE 2

The second set of melt chemistries set forth in Table 2 was submitted for vacuum melt process. The compositions in this study are shown below:

TABLE 2

| ID | C | Mn | P | S | Si | Cr | Ni | Cu | Mo | N | Cb | Ti |
|---|---|---|---|---|---|---|---|---|---|---|---|---|
| 02 | 0.015 | 0.30 | 0.027 | 0.0026 | 0.36 | 20.82 | 0.25 | 0.24 | 0.25 | 0.014 | 0.20 | 0.15 |
| 51 | 0.014 | 0.30 | 0.026 | 0.0026 | 0.36 | 20.76 | 0.24 | 0.94 | 0.25 | 0.014 | 0.20 | 0.17 |
| 91 | 0.016 | 0.29 | 0.028 | 0.0026 | 0.35 | 20.72 | 0.25 | 0.48 | 0.25 | 0.014 | 0.20 | 0.17 |
| 92 | 0.016 | 0.29 | 0.028 | 0.0026 | 0.36 | 20.84 | 0.25 | 0.74 | 0.25 | 0.014 | 0.20 | 0.15 |

The above mentioned heats varied mainly in copper content. Additional vacuum heats, of the compositions set forth in Table 3, were also melted for comparison purposes. The Type 304L steel used for comparison was commercially available sheet.

TABLE 3

| ID | C | Mn | P | S | Si | Cr | Ni | Cu | Mo | N | Cb | Ti |
|---|---|---|---|---|---|---|---|---|---|---|---|---|
| 31 | 0.016 | 0.33 | 0.028 | 0.0030 | 0.42 | 20.70 | 0.24 | <0.002 | <0.002 | 0.0057 | 0.21 | 0.15 |
| 41 | 0.016 | 0.32 | 0.027 | 0.0023 | 0.36 | 18.63 | 0.25 | 0.48 | 0.24 | 0.014 | 0.18 | 0.16 |
| 52 | 0.015 | 0.30 | 0.026 | 0.0026 | 0.36 | 20.78 | 0.24 | 0.94 | 0.25 | 0.014 | 0.20 | 0.16 |
| 304L AIM | 0.023 | 1.30 | 0.040 | 0.005 max | 0.35 | 18.25 | 8.10 | — | 0.50 max | 0.030 | — | — |

The chemistries of Table 3 were vacuum melted into ingots, hot rolled at 2250 F (1232° C.), descaled and cold reduced 60%. The cold reduced material had a final anneal at 1825 F (996° C.) followed by a final descale.

EXAMPLE 3

Comparison studies performed on the above mentioned vacuum melts of Example 2 (identified by their ID numbers) were chemical immersion tested in hydrochloric acid, sulfuric acid, sodium hypochlorite, and acetic acid.

1% Hydrochloric Acid.

Figure 2:
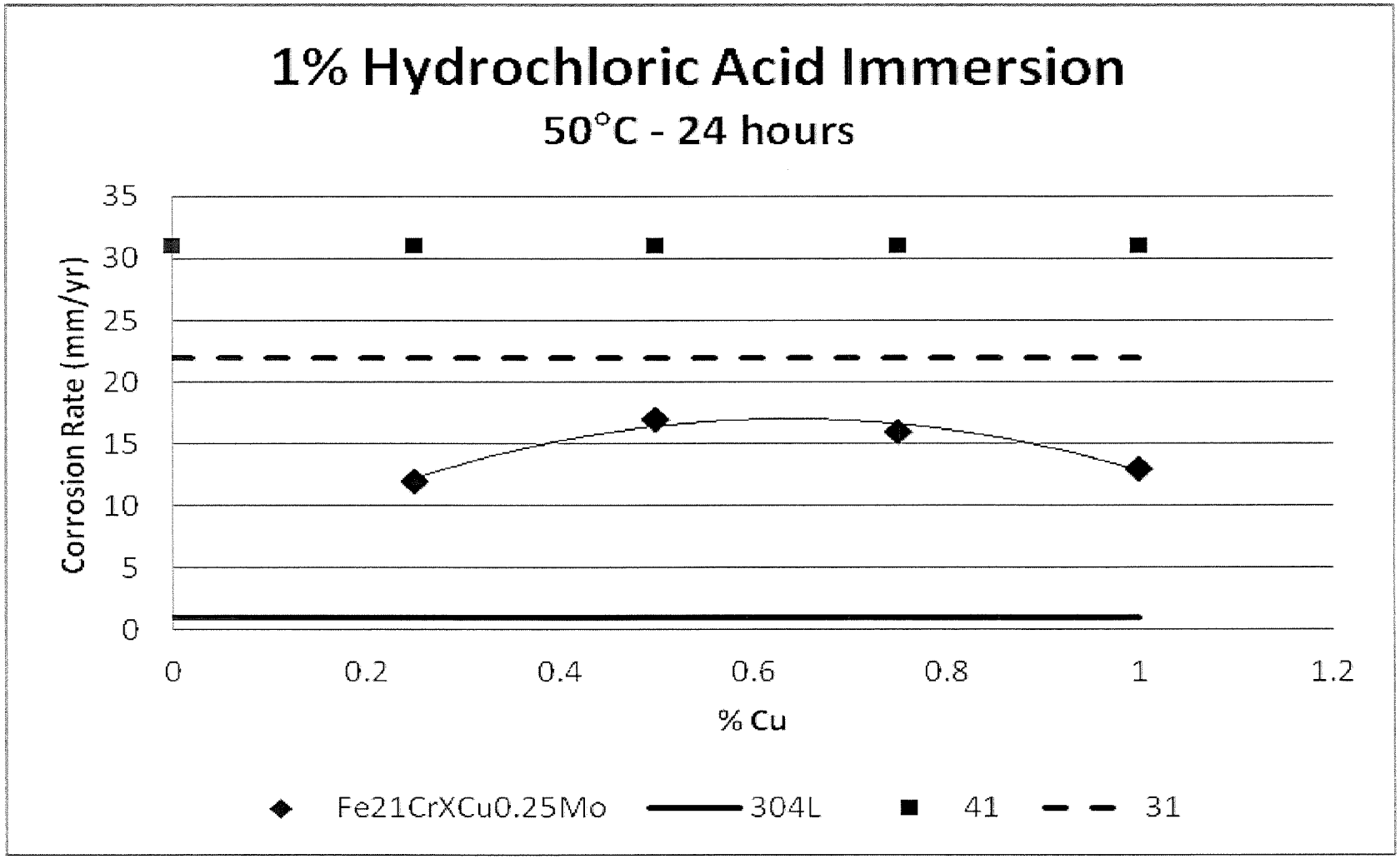
FIG. 2 is a graph depicting corrosion rate as a function of steel composition in a reducing acidic chloride environment such as hydrochloric acid.

As shown in FIG. 2, the chemical immersion evaluations showed the beneficial effects of nickel in a reducing acidic chloride environment such as hydrochloric acid. Type 304L steel outperformed all of the chemistries studied in this environment. The addition of chromium resulted in a lower overall corrosion rate and the presence of copper and molybdenum showed a further reduction of corrosion rate but the effects of copper alone were minimal as shown by the graph of the line identified as Fe21CrXCu0.25Mo in FIG. 2. This behavior supports the benefits of nickel additions for service conditions such as the one described below.

5% Sulfuric Acid.

Figure 3:
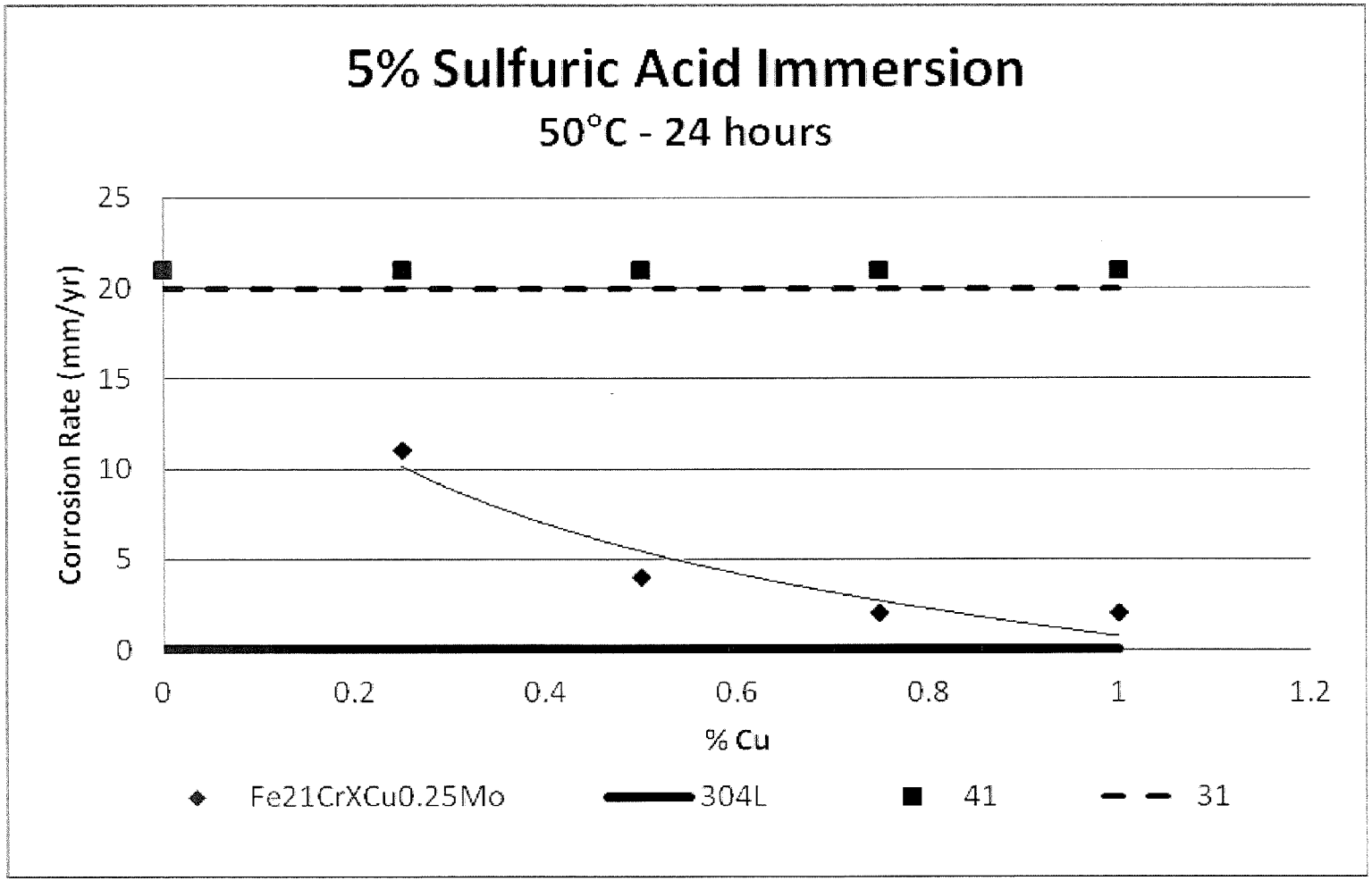
FIG. 3 is a graph depicting corrosion rate as a function of steel composition in a reducing acid that is sulfate rich.

As shown in FIG. 3, in an immersion test consisting of a reducing acid that is sulfate rich, alloys with chromium levels between 18-21% behaved similarly. The addition of molybdenum and copper significantly reduced the overall corrosion rate. When evaluating the effects of copper alone on the corrosion rate (as indicated by the graph of the line identified as Fe21CrXCu0.25Mo in FIG. 3), it appeared as though there is a direct relationship in that the higher the copper, the lower the corrosion rate. At the 0.75% copper level the overall corrosion rate began to level off and was within 2 mm/yr of 304L steel. Molybdenum at the 0.25% level tends to play a large role in the corrosion rate in sulfuric acid. However, the dramatic reduction in rate was also attributed to the copper presence. Though the alloys of Example 2 did not have a rate of corrosion below Type 304L steel they did show improved and comparable corrosion resistance under reducing sulfuric acid conditions.

Acetic Acid and Sodium Hypochlorite.

In acid immersions consisting of acetic acid and 5% sodium hypochlorite, the corrosion behavior was comparable to that of Type 304L steel. The corrosion rates were very low and no true trend in copper addition was observed in the corrosion behavior. All investigated chemistries of Example 2 having a chromium level above 20% were within 1 mm/yr of Type 304L steel.

EXAMPLE 4

Electrochemical evaluations including corrosion behavior diagrams (CBD) and cyclic polarization studies were performed and compared to the behavior of Type 304L steel.

Figure 4:
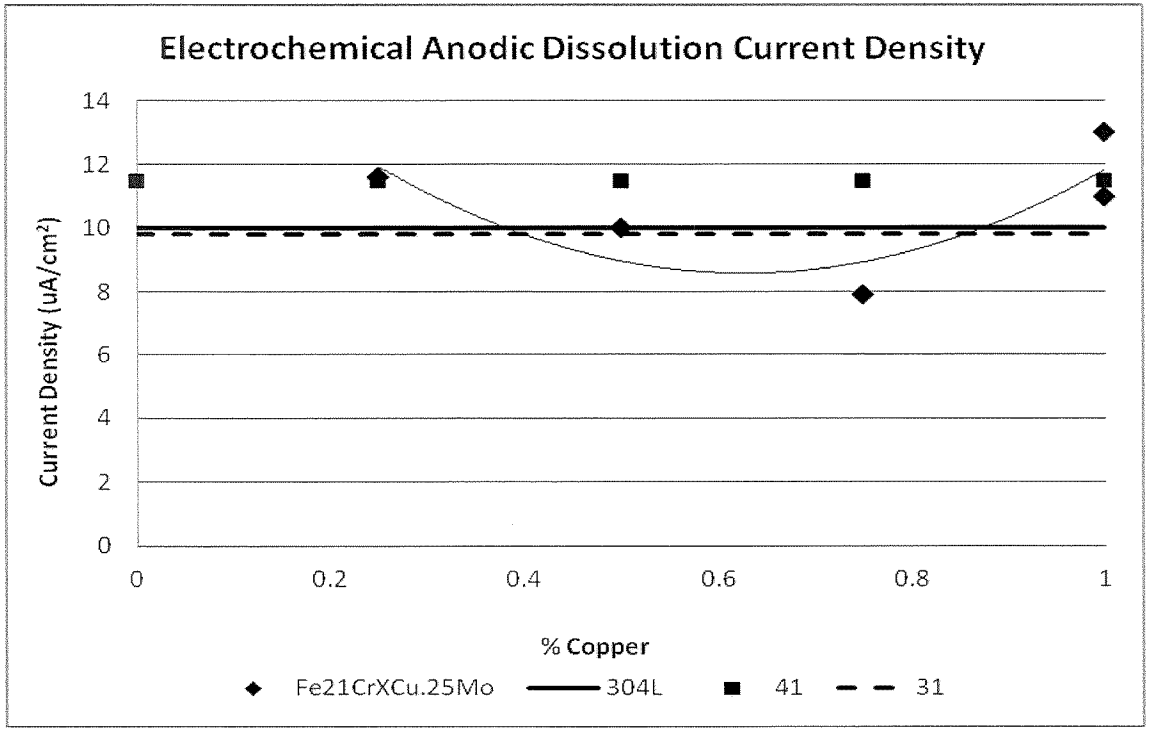
FIG. 4 is a graph depicting electrochemical anodic dissolution current density as a function of steel composition.

Corrosion behavior diagrams were collected on the vacuum heat chemistries of Example 2 and commercially available Type 304L in 3.5% sodium chloride in order to investigate the effects of copper on the anodic dissolution behavior. The anodic nose represents the electrochemical dissolution that takes place at the surface of the material prior to reaching a passive state. As shown in FIG. 4, an addition of at least 0.25% molybdenum and a minimum of approximately 0.40% copper reduce the current density during anodic dissolution to below the measured value for Type 304L steel. It is also noted that the maximum copper addition that allows the anodic current density to remain below that measured for Type 304L steel falls approximately around 0.85%, as shown by the graph of the line identified as Fe21CrXCu0.25Mo in FIG. 4. This shows that a small amount of controlled copper addition while in the presence of 21% Cr and 0.25% molybdenum does slow the anodic dissolution rate in dilute chlorides but there is an optimal amount in order to maintain a rate slower than shown for Type 304L steel.

Cyclic polarization scans were collected on the experimental chemistries of Examples 2 and commercially available Type 304L steel in 3.5% sodium chloride solution. These polarization scans show the anodic behavior of the ferritic stainless steel through active anodic dissolution, a region of passivity, a region of transpassive behavior and the breakdown of passivity. Additionally the reverse of these polarization scans identifies the repassivation potential.

Figure 5:
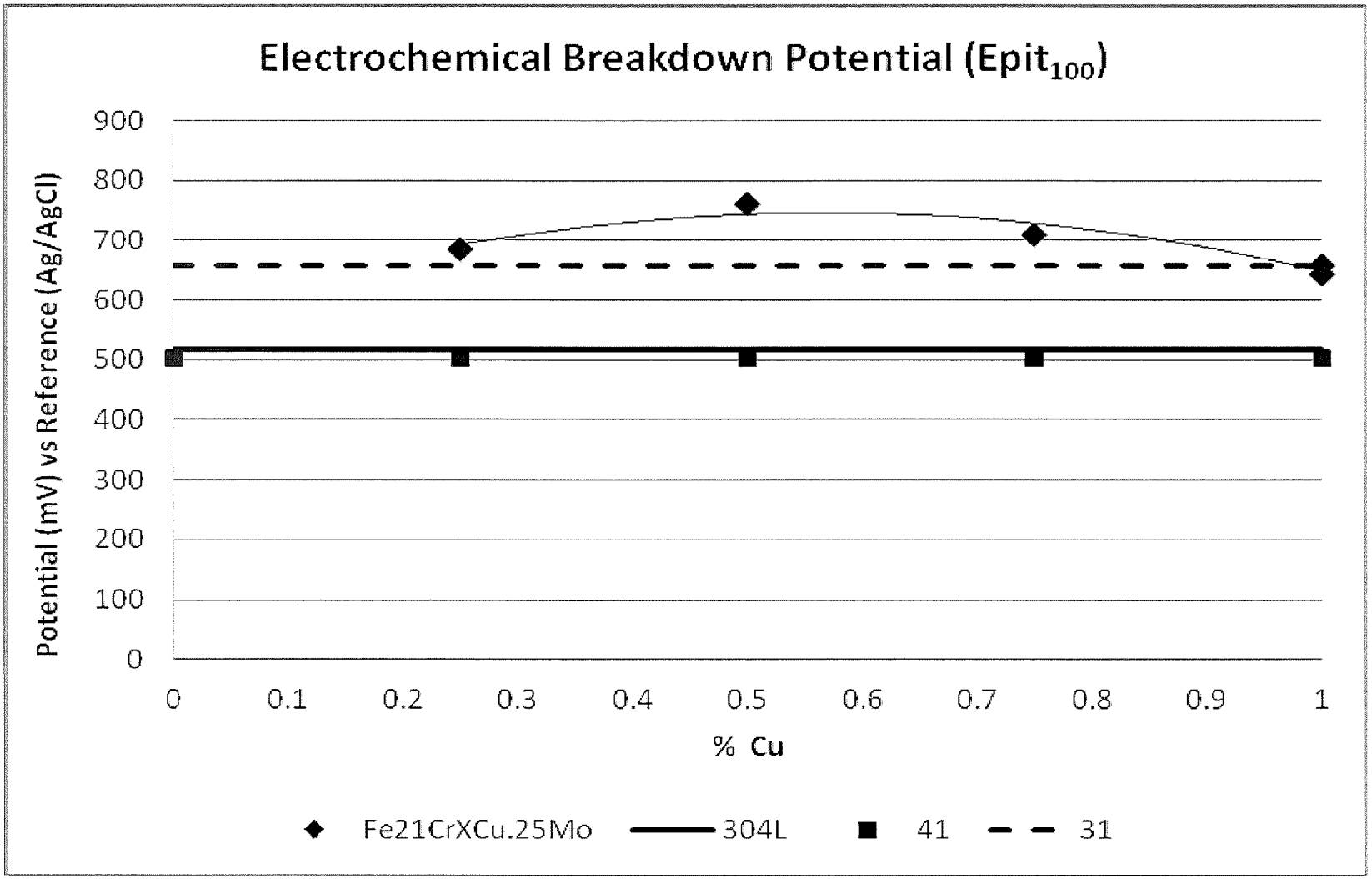
FIG. 5 is a graph depicting electrochemical breakdown potential as a function of steel composition.
Figure 6:
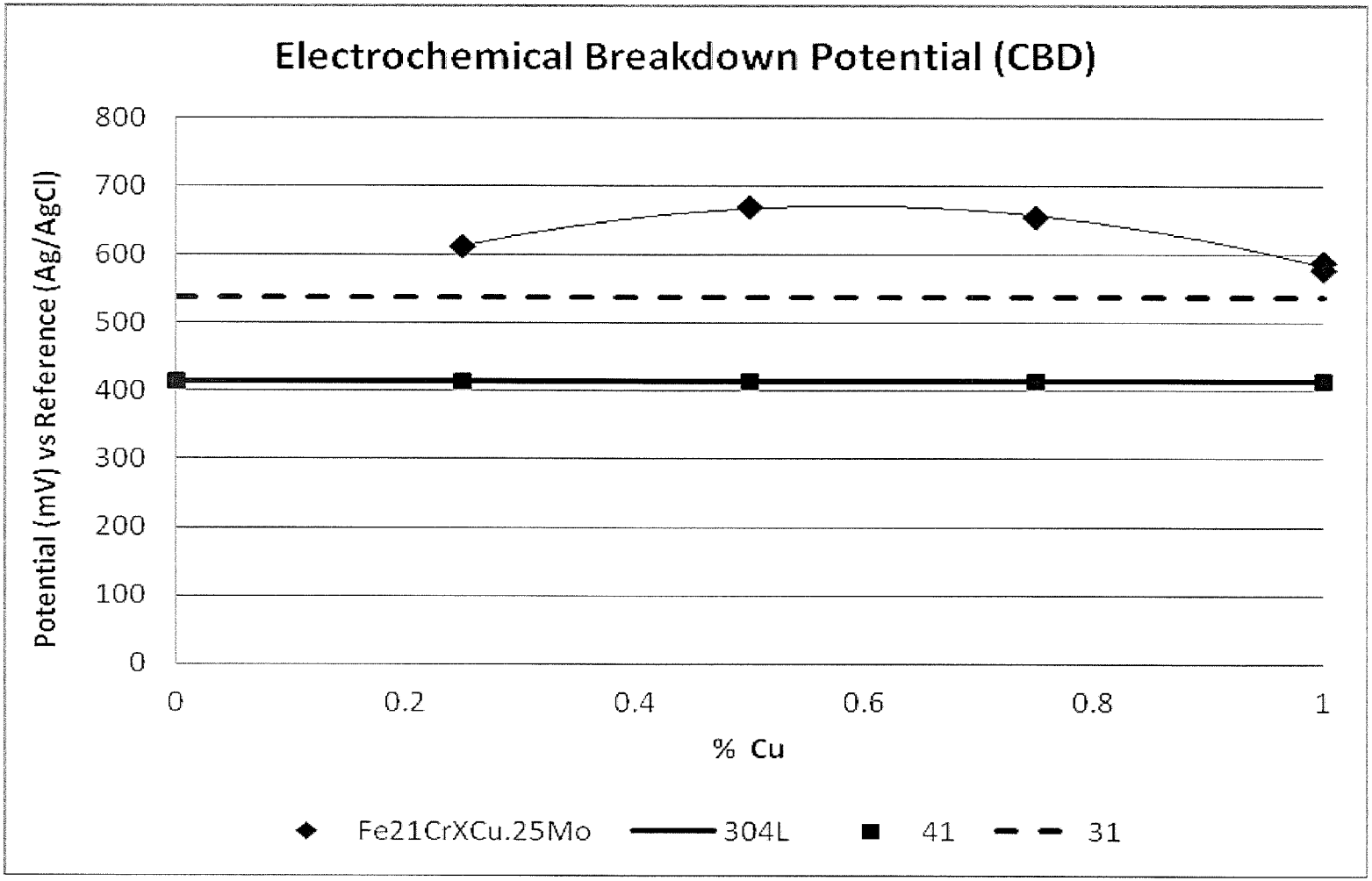
FIG. 6 is a graph depicting electrochemical breakdown potential as a function of steel composition.

The breakdown potential exhibited in the above mentioned cyclic polarization scans was documented as shown in FIG. 5 and FIG. 6, and evaluated to measure the effects of copper additions, if any. The breakdown potential was determined to be the potential at which current begins to consistently flow through the broken passive layer and active pit imitation is taking place.

Much like the anodic dissolution rate, the addition of copper, as shown by the graph of the line identified as Fe21CrXCu0.25Mo in FIGS. 5 and 6, appears to strengthen the passive layer and shows that there is an optimal amount needed to maximize the benefits of copper with respect to pit initiation. The range of maximum passive layer strength was found to be between 0.5-0.75% copper while in the presence of 0.25% molybdenum and 21% Cr. This trend in behavior was confirmed from the CBD collected during the study of anodic dissolution discussed above though due to scan rate differences the values are shifted lower.

Figure 7:
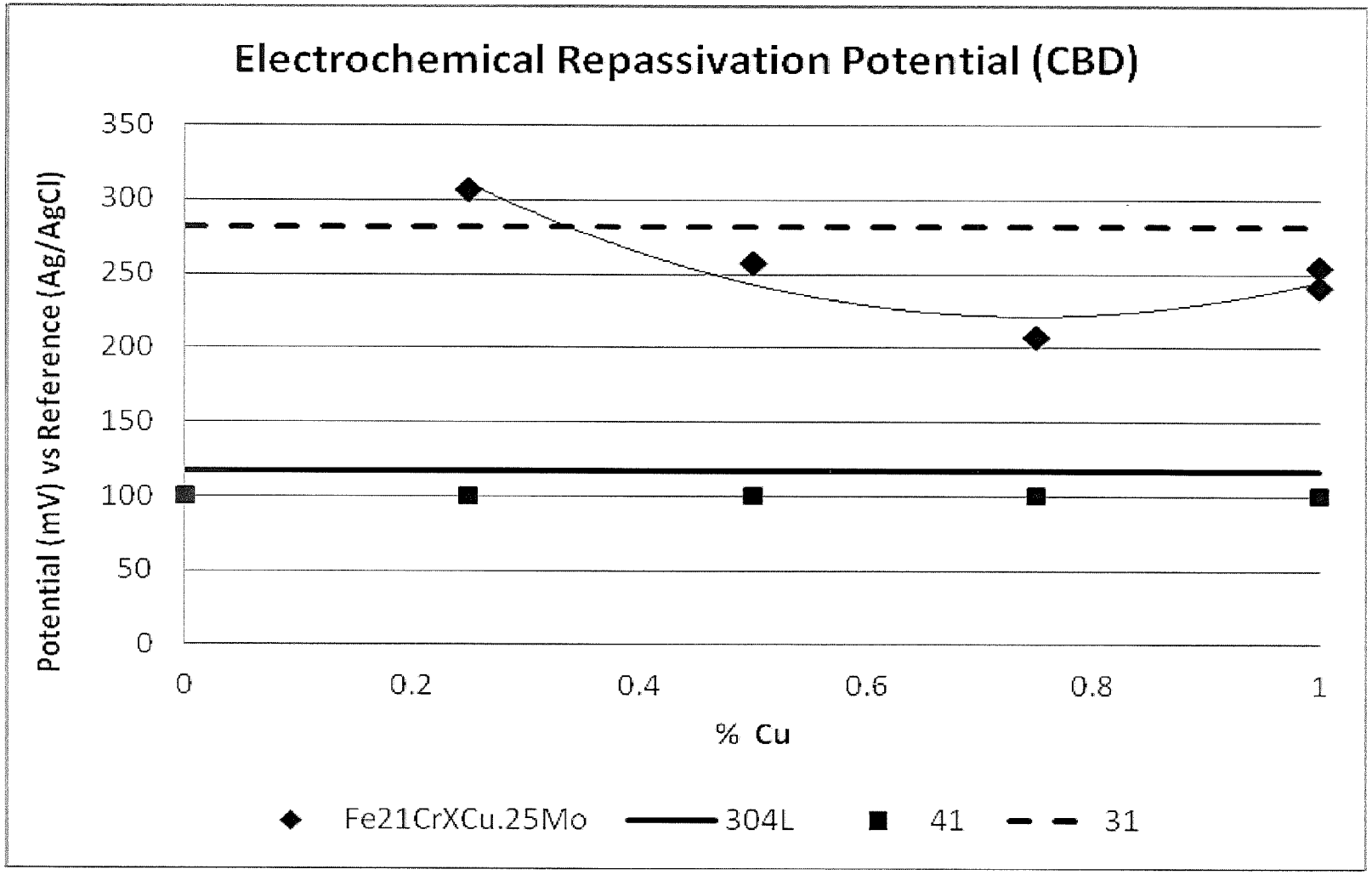
FIG. 7 is a graph depicting electrochemical repassivation potential as a function of steel composition.
Figure 8:
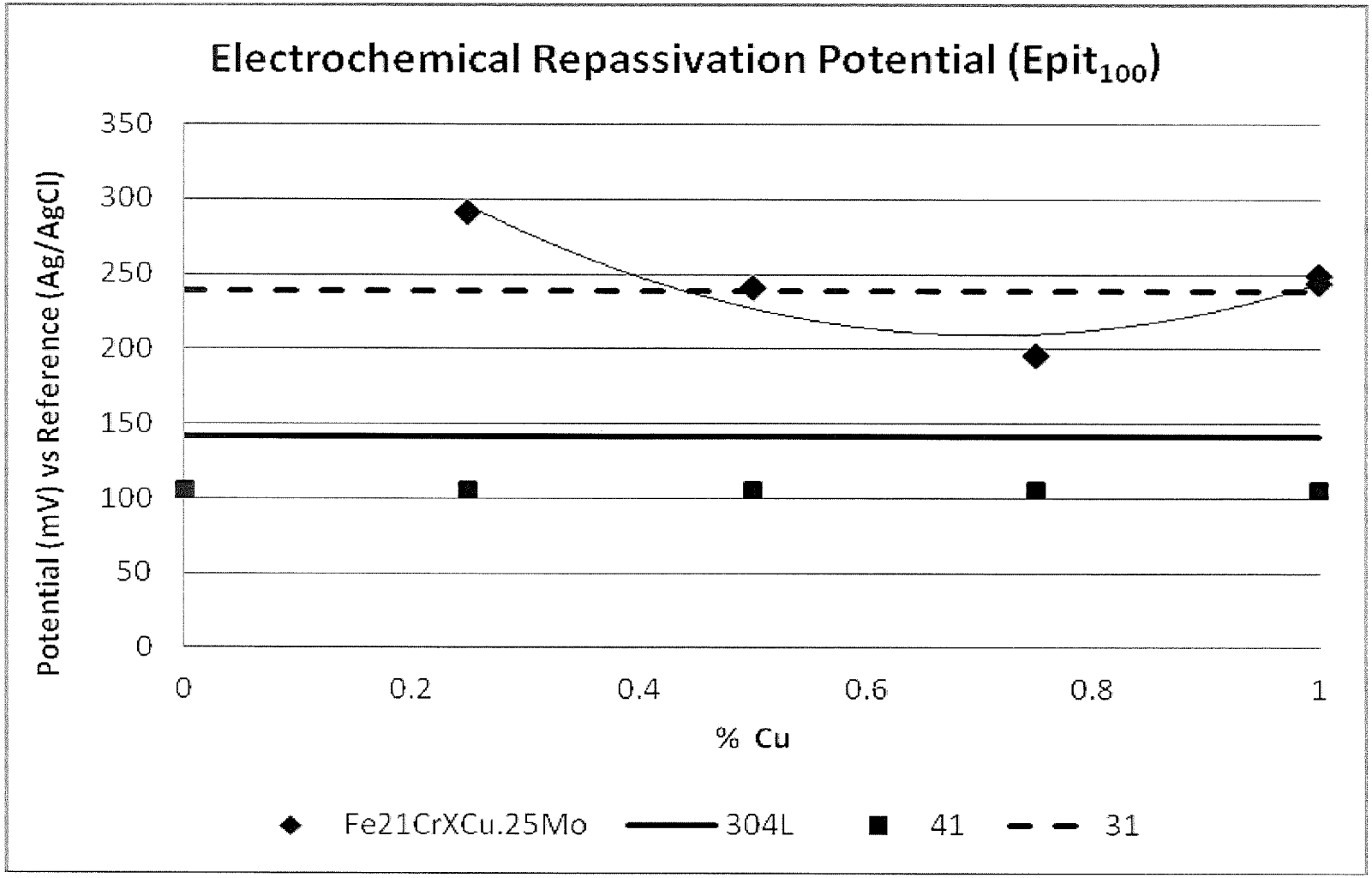
FIG. 8 is a graph depicting electrochemical repassivation potential as a function of steel composition.

When evaluating the repassivation behavior of the vacuum melted chemistries of Example 2 it showed that a chromium level of 21% and a small molybdenum addition can maximize the repassivation reaction. The relationship of copper to the repassivation potential appeared to become detrimental as the copper level increased, as shown by the graph of the line identified as Fe21CrXCu0.25Mo in FIG. 7 and FIG. 8. As long as the chromium level was approximately 21% and a small amount of molybdenum was present, the investigated chemistries of Examples 2 were able to achieve a repassivation potential that was higher than Type 304L steel, as shown by FIG. 7 and FIG. 8.

EXAMPLE 5

A ferritic stainless steel of the composition set forth below in Table 4 (ID 92, Example 2) was compared to Type 304L steel with the composition set forth in Table 4:

TABLE 4

| Alloy | C | Cr | Ni | Si | Ti | Cb(Nb) | Other |
|---|---|---|---|---|---|---|---|
| ID 92 | 0.016 | 20.84 | 0.25 | 0.36 | 0.15 | 0.20 | 0.74 Cu, 0.25 Mo |
| 304L | 0.02 | 18.25 | 8.50 | 0.50 | — | — | 1.50 Mn |

The two materials exhibited the following mechanical properties set forth in Table 5 when tested according to ASTM standard tests:

TABLE 5

| Mechanical Properties | | | | |
|---|---|---|---|---|
| | 0.2% YS ksi (MPa) | UTS ksi (MPa) | % Elongation (2") | Hardness $R_B$ |
| ID 92 | 54.5 (376) | 72.0 (496) | 31 | 83.5 |
| 304 | 40.0 (276) | 90.0 (621) | 57 | 81.0 |

Figure 9:
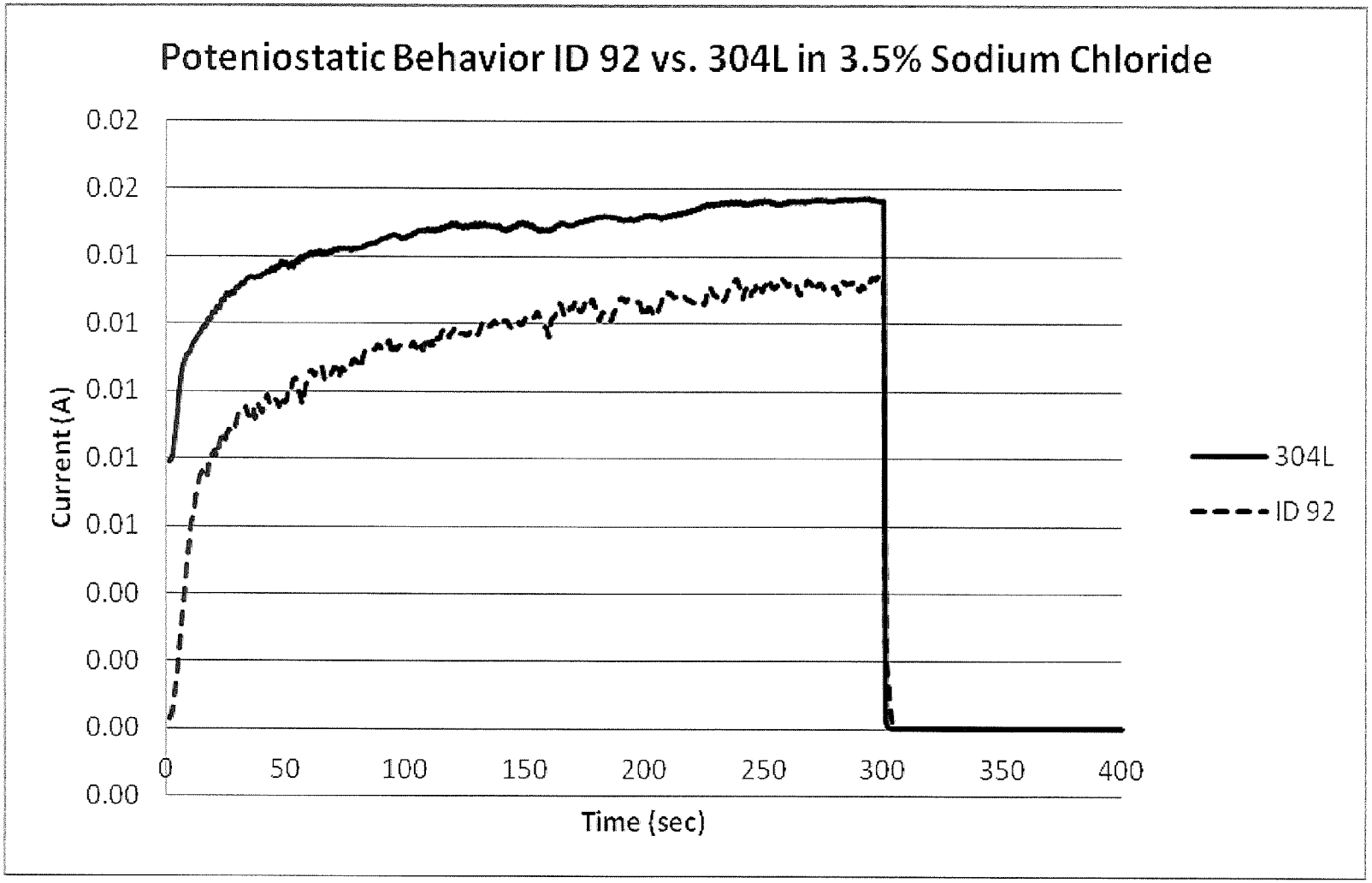
FIG. 9 is a graph depicting comparative potentiostatic behavior of a ferritic stainless steel and a comparative steel.
Figure 10:
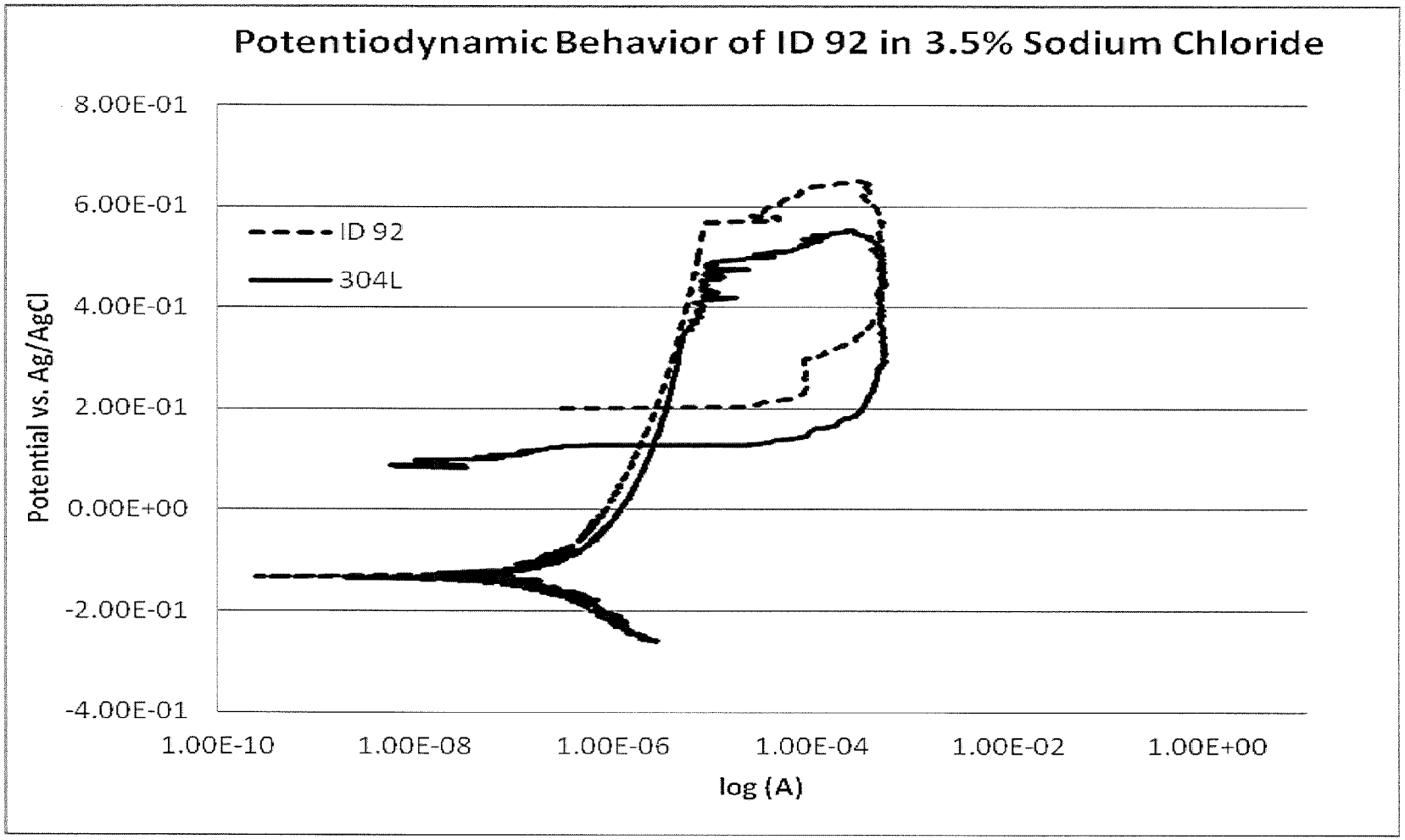
FIG. 10 graph depicting comparative potentiodynamic behavior of a ferritic stainless steel and a comparative steel.

The material of Example 2, ID 92 exhibits more electrochemical resistance, higher breakdown potential, and higher repassivation potential than the comparative Type 304L steel, as shown in FIG. 9 and FIG. 10.

It will be understood various modifications may be made to this invention without departing from the spirit and scope of it. Therefore, the limits of this invention should be determined from the appended claims.

What is claimed is:

1. A ferritic stainless steel consisting essentially of:
about 0.020 or less percent by weight carbon;
about 20.0-23.0 percent by weight chromium;
about 0.020 or less percent by weight nitrogen;
about 0.40-0.80 percent by weight copper;
about 0.20-0.60 percent by weight molybdenum;
about 0.10-0.25 percent by weight titanium;
about 0.20-0.30 percent by weight columbium,
optionally one or more members selected from the group consisting of 0.50 or less percent by weight manganese, 0.030 or less percent by weight phosphorus, 0.30-0.50 percent by weight silicon, and 0.040 or less percent by weight nickel, and
the balance consisting of iron and unavoidable impurities.

2. The ferritic stainless steel of claim 1 wherein the chromium is present in an amount of about 21.5-22 percent by weight.

3. The ferritic stainless steel of claim 1 wherein the copper is present in an amount of about 0.45-0.75 percent by weight.

4. The ferritic stainless steel of claim 1 wherein the molybdenum is present in an amount of about 0.30-0.50 percent by weight.

5. The ferritic stainless steel of claim 1 wherein the titanium is present in an amount of about 0.17-0.25 percent by weight.

6. The ferritic stainless steel of claim 1 wherein the chromium is present in an amount of about 21.75 percent by weight.

7. The ferritic stainless steel of claim 1 wherein the copper is present in an amount of about 0.60 percent by weight.

8. The ferritic stainless steel of claim 1 wherein the molybdenum is present in an amount of about 0.40 percent by weight.

9. The ferritic stainless steel of claim 1 wherein the titanium is present in an amount of about 0.21 percent by weight.

10. The ferritic stainless steel of claim 1 wherein the columbium is present in an amount of about 0.25 percent by weight.

11. The ferritic stainless steel of claim 1 further consisting essentially of about 0.30-0.50 percent by weight manganese.

12. The ferritic stainless steel of claim 1 further consisting essentially of one or more members selected from the group consisting of 0.40 or less percent by weight manganese, 0.030 or less percent by weight phosphorus, 0.30-0.50 percent by weight silicon, and 0.040 or less percent by weight nickel.

13. The ferritic stainless steel of claim 1, wherein the concentrations of chromium and molybdenum satisfy Equation 1:

$$20.5 \leq Cr+3.3Mo \qquad \text{Equation 1:}$$

wherein Cr is the concentration of chromium by percent weight, and Mo is the concentration of molybdenum by percent weight.

14. The ferritic stainless steel of claim 1, wherein the concentrations of copper and molybdenum satisfy Equation 2:

$$0.6 \leq Cu+Mo \leq 1.4 \text{ when } Cu_{max} < 0.80 \qquad \text{Equation 2:}$$

wherein Cu is the concentration of copper by percent weight, wherein Mo is the concentration of molybdenum by percent weight, wherein $Cu_{max}$ is the maximum concentration of copper by percent weight.

15. The ferritic stainless steel of claim 1, wherein the concentration of titanium satisfies Equations 3 and 4:

$$Ti_{max} = 0.0044(N^{-1.027}) \qquad \text{Equation 3:}$$

wherein $Ti_{max}$ is that maximum concentration of titanium by percent weight, wherein N is the concentration of nitrogen by percent weight; and $$Ti_{min} = 0.0025/N \qquad \text{Equation 4:}$$

wherein $Ti_{min}$ is the minimum concentration of titanium by percent weight, wherein N is the concentration of nitrogen by percent weight.

16. A ferritic stainless steel comprising:
about 0.020 or less percent by weight carbon;
about 20.0-23.0 percent by weight chromium;
about 0.020 or less percent by weight nitrogen;
about 0.40-0.80 percent by weight copper;
about 0.20-0.60 percent by weight molybdenum;
about 0.10-0.25 percent by weight titanium; and
about 0.20-0.30 percent by weight columbium,
wherein the concentrations of chromium and molybdenum satisfy Equation 1:

$$20.5 \leq Cr+3.3Mo \qquad \text{Equation 1:}$$

wherein Cr is the concentration of chromium by percent weight, and Mo is the concentration of molybdenum by percent weight,
wherein the concentrations of copper and molybdenum satisfy Equation 2:

$$0.6 \leq Cu+Mo \leq 1.4 \text{ when } Cu_{max} < 0.80 \qquad \text{Equation 2:}$$

wherein Cu is the concentration of copper by percent weight, wherein Mo is the concentration of molybdenum by percent weight, wherein $Cu_{max}$ is the maximum concentration of copper by percent weight, wherein the concentration of titanium satisfies Equations 3 and 4:

$$Ti_{max}=0.0044(N-1.027) \quad \text{Equation 3:}$$

wherein $Ti_{max}$ is that maximum concentration of titanium by percent weight, wherein N is the concentration of nitrogen by percent weight; and $$Ti_{min}=0.0025/N \quad \text{Equation 4:}$$

wherein $Ti_{min}$ is the minimum concentration of titanium by percent weight, wherein N is the concentration of nitrogen by percent weight.

* * * * *